US007702255B2

(12) United States Patent
Ishii

(10) Patent No.: US 7,702,255 B2
(45) Date of Patent: Apr. 20, 2010

(54) OPENING/CLOSING MECHANISM, IMAGE FORMING APPARATUS AND GEAR MECHANISM

(75) Inventor: Hirotaka Ishii, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 592 days.

(21) Appl. No.: 11/682,952

(22) Filed: Mar. 7, 2007

(65) Prior Publication Data

US 2008/0034909 A1 Feb. 14, 2008

(30) Foreign Application Priority Data

Mar. 15, 2006 (JP) ..... 2006-071147

(51) Int. Cl.
*G03G 21/00* (2006.01)

(52) U.S. Cl. ..... 399/124; 399/125

(58) Field of Classification Search ..... 399/124, 399/125

See application file for complete search history.

(56) References Cited

U.S. PATENT DOCUMENTS

| | | | | |
|---|---|---|---|---|
| 5,121,521 | A * | 6/1992 | Hagiwara et al. | 16/278 |
| 6,241,300 | B1 * | 6/2001 | Suzuki | 296/37.8 |
| 6,609,631 | B2 * | 8/2003 | Asami | 220/817 |
| 7,187,537 | B2 * | 3/2007 | Liao | 361/679.09 |
| 7,591,395 | B2 * | 9/2009 | Hamaguchi | 220/830 |
| 2005/0133507 | A1 * | 6/2005 | Tanaka | 220/263 |
| 2005/0252759 | A1 * | 11/2005 | Ichimaru | 200/523 |
| 2006/0006093 | A1 * | 1/2006 | Yang | 206/701 |

FOREIGN PATENT DOCUMENTS

| | | |
|---|---|---|
| JP | 2-19563 | 2/1990 |
| JP | 4-75073 | 6/1992 |
| JP | 07-244410 | 9/1995 |
| JP | 7-326102 | 12/1995 |
| JP | 2001-088854 | 4/2001 |

* cited by examiner

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

A gear mechanism comprises a first gear which has a portion with no teeth and rotates, a second gear which engages the first gear and a cam mechanism which includes a cam portion provided on one gear of the first gear and the second gear and a cam contact portion provided on the other gear of the first gear and the second gear and making contact with the cam portion. When the second gear moves from a position in which the second gear engages the tooth portion of the first gear to a position in which the second gear opposes the portion with no teeth of the first gear, the cam mechanism acts to bring the axes of the first gear and the second gear away from each other.

10 Claims, 11 Drawing Sheets

DETAIL OF CAM PORTION

DETAIL OF CAM PORTION

OPENING/CLOSING MECHANISM, IMAGE FORMING APPARATUS AND GEAR MECHANISM

BACKGROUND OF THE INVENTION

1. Field of the Invention

The present invention relates to an image forming apparatus including a gear mechanism, an opening/closing mechanism, and an opening/closing member.

2. Description of Related Art

An image forming apparatus has a damper mechanism in order to prevent the occurrence of a fault that a cover provided thereon closes too quickly (Japanese Patent Application Laid-open No. 07-244410).

If the damper mechanism is provided, it is necessary to prevent the cover from being not closed completely by receiving a reaction force of the damper. According to a conventionally proposed concept, a fractional gear is engaged with a gear which receives a force of the damper and when the cover is closed, the fractional gear is released from the engagement, so that the reaction force of the damper is not received.

However, according to this structure, when the fractional gear is about to be released from the engagement, the engagement between the fractional gear and the gear having the damper is maintained by engagement of only a tooth of the fractional gear. In a condition of the engagement with this single tooth, the reaction force of the damper applied to the tooth of the fractional gear becomes large and a large shock sound occurs when the engagement of the fractional gear is released. For this countermeasure, it is necessary to use a large fractional gear so as to reduce a reaction force of the damper applied to the tooth, thereby softening the shock sound.

SUMMARY OF THE INVENTION

An object of the invention is to provide a gear mechanism, an opening/closing mechanism, and an image forming apparatus capable of reducing a sound which occurs when engagement of the gears is released while reduction of the gear size is ensured.

To achieve above-mentioned object, an opening/closing mechanism according to the present invention comprises:

an opening/closing member capable of opening and closing with respect to a main body;

a first gear having a tooth portion and a portion with no teeth, the first gear rotating with opening and closing of the opening/closing member;

a second gear engaging the first gear, provided rotatably on the main body; and a cam mechanism including a cam rotatable with the first gear and a cam contact portion making contact with the cam, wherein when the opening/closing member is opened, the second gear engages the tooth portion of the first gear and when the opening/closing member is closed, the second gear opposes the portion with no teeth of the first gear, and when the opening/closing member is rotated to be closed so that it is moved from an opening/closing angle in which the second gear opposes the tooth portion of the first gear to an opening/closing angle in which the second gear opposes the portion with no teeth of the first gear, the cam mechanism acts to bring the axes of the first gear and the second gear away from each other.

An opening/closing mechanism according to the present invention comprises:

an opening/closing member capable of opening and closing with respect to a main body;

a first gear rotating with opening and closing of the opening/closing member;

a second gear engaging the first gear; and a cam mechanism acts to bring the axes of the first gear and the second gear away from each other when the opening/closing member is closed.

In addition, a gear mechanism according to the present invention comprises:

a first gear;

a second gear which engages the first gear; and a cam mechanism including a cam portion provided on one of the first gear and the second gear and a cam contact portion which is provided on the other gear of the first gear and the second gear and makes contact with the cam portion, the cam mechanism acting to releasing the engaging of the first gear and the second gear by bring the axes of the first gear and the second gear away from each other.

According to the present invention, the sound which occurs when the engagement of the gears is released can be relaxed.

DESCRIPTION OF THE EMBODIMENTS

Figure 1:
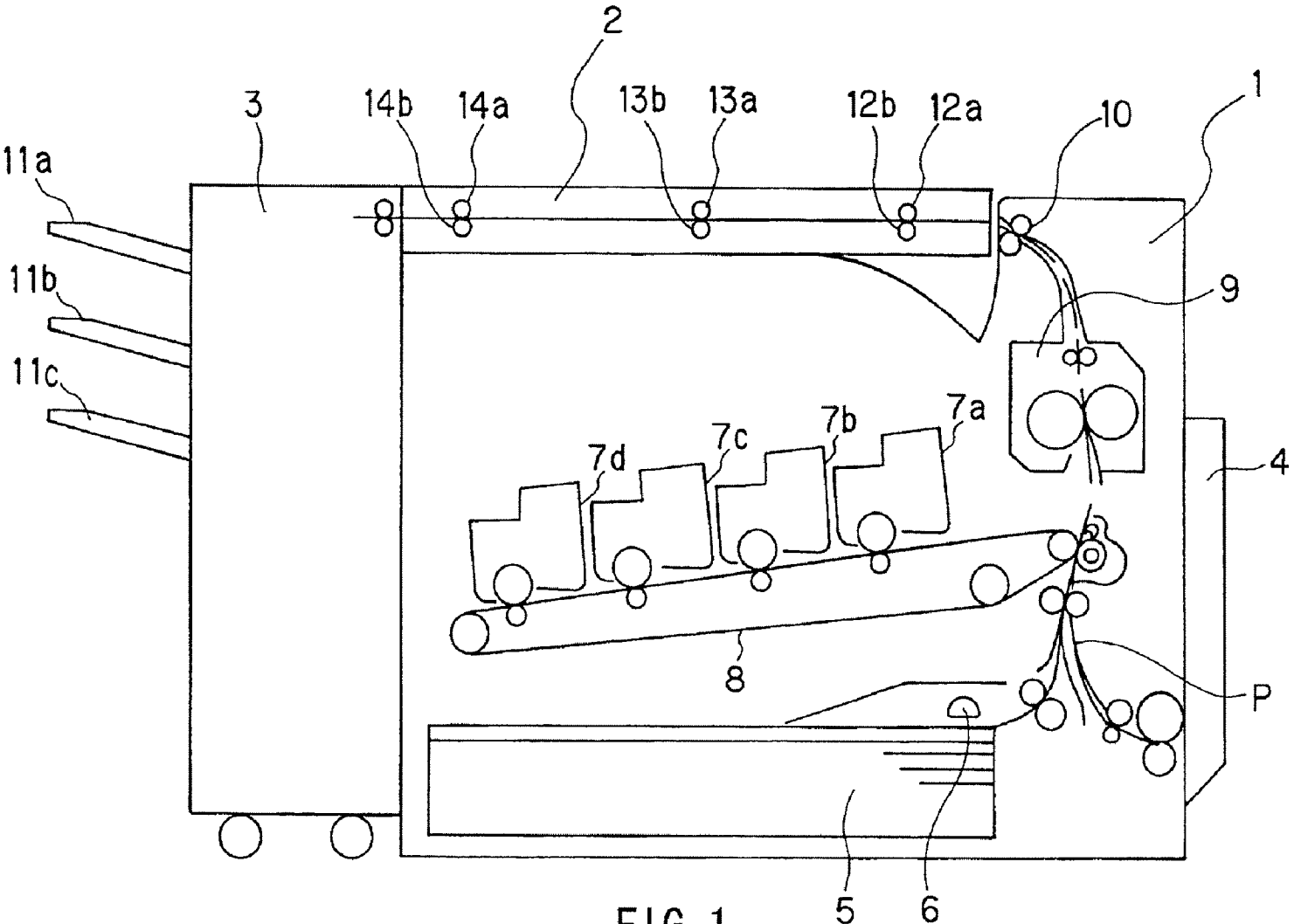
FIG. 1 is a sectional view showing the structure of major components of a color image forming apparatus according to a first embodiment of the invention.

Hereinafter, the preferred embodiments of the present invention will be described with reference to the accompanying drawings. In all Figures of following embodiments, like reference numerals are attached to the same or corresponding components.

First Embodiment

Hereinafter, the first embodiment of the present invention will be described with reference to the drawings. FIG. 1 shows an image forming apparatus according to the first embodiment.

As shown in FIG. 1, the image forming apparatus of the first embodiment comprises an image forming apparatus main body 1, a relay conveying unit 2 and a sheet post-processing unit 3. The relay conveying unit 2 is installed substantially horizontally on the top face of the main body 1.

A sheet feeding portion 6 is provided on the bottom of the image forming apparatus main body 1. The image forming apparatus main body 1 includes inside of the body an image forming portion 7 as an image forming means, a transfer unit 8 as a transfer means, a fixing unit 9 as a fixing means and a normal sheet discharge portion 10.

The transfer unit 8 is a unit for transferring an image formed by the image forming portion 7 to a sheet. The fixing unit 9 is a unit for fixing a toner image transferred to the sheet. The normal sheet discharge portion 10 is a means for discharging a sheet on which the toner image is fixed out of the apparatus.

The sheet discharged out of the normal sheet discharge portion 10 of the apparatus main body 1 is conveyed to the top of the image forming apparatus main body 1 by the relay conveying unit 2 which is a conveying device for conveying the sheet on which the image is formed by the image forming portion 7. This sheet is conveyed into the sheet post-processing unit 3 provided on the side face of the image forming apparatus main body 1 and after the sheet post-processing is performed, it is discharged onto a discharged sheet tray 11 provided in the sheet post-processing unit 3.

(Relay Conveying Unit)

Figure 2:
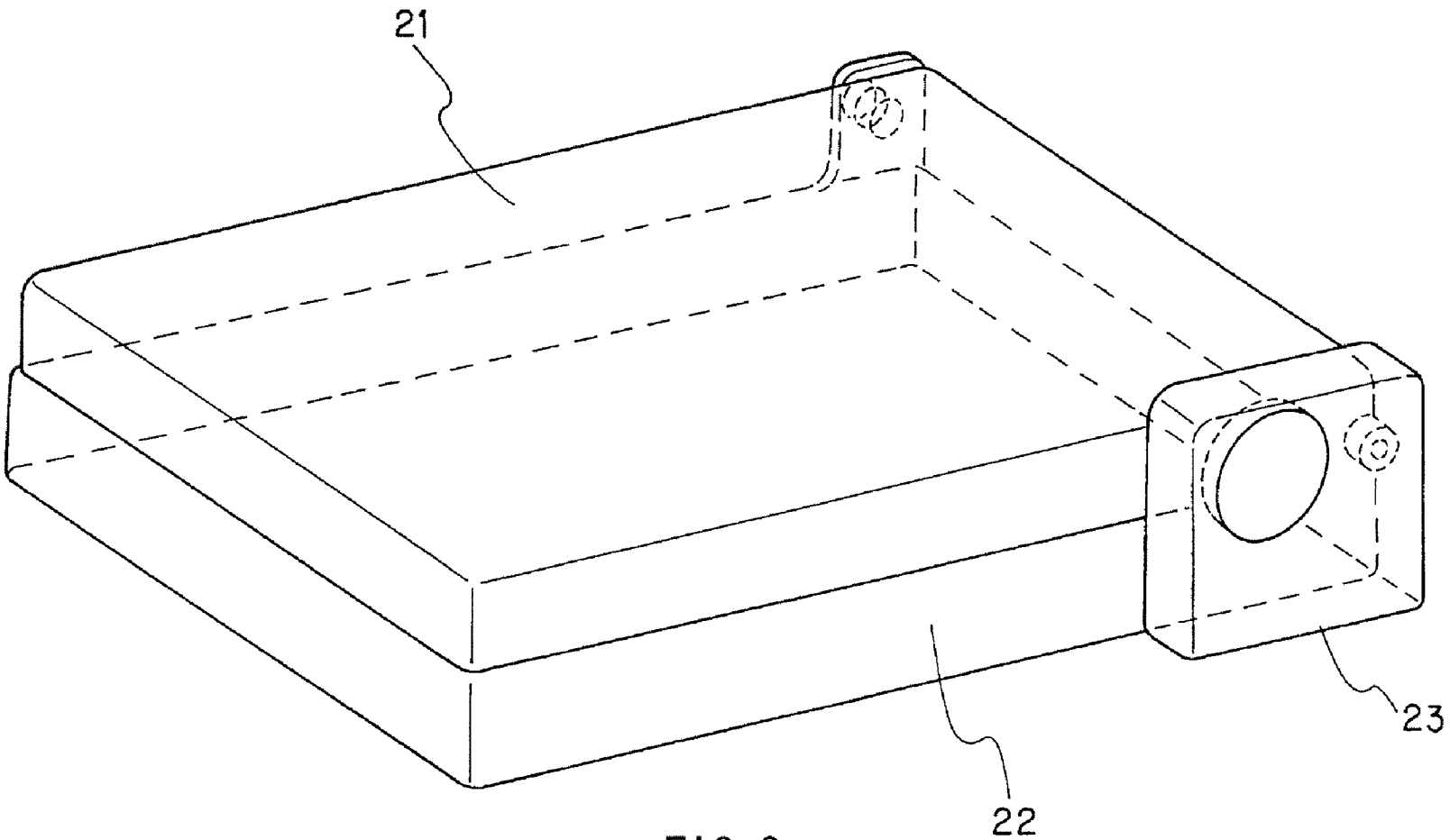
FIG. 2 is a perspective view for explaining a relay conveying unit according to the first embodiment of the present invention.
Figure 3:
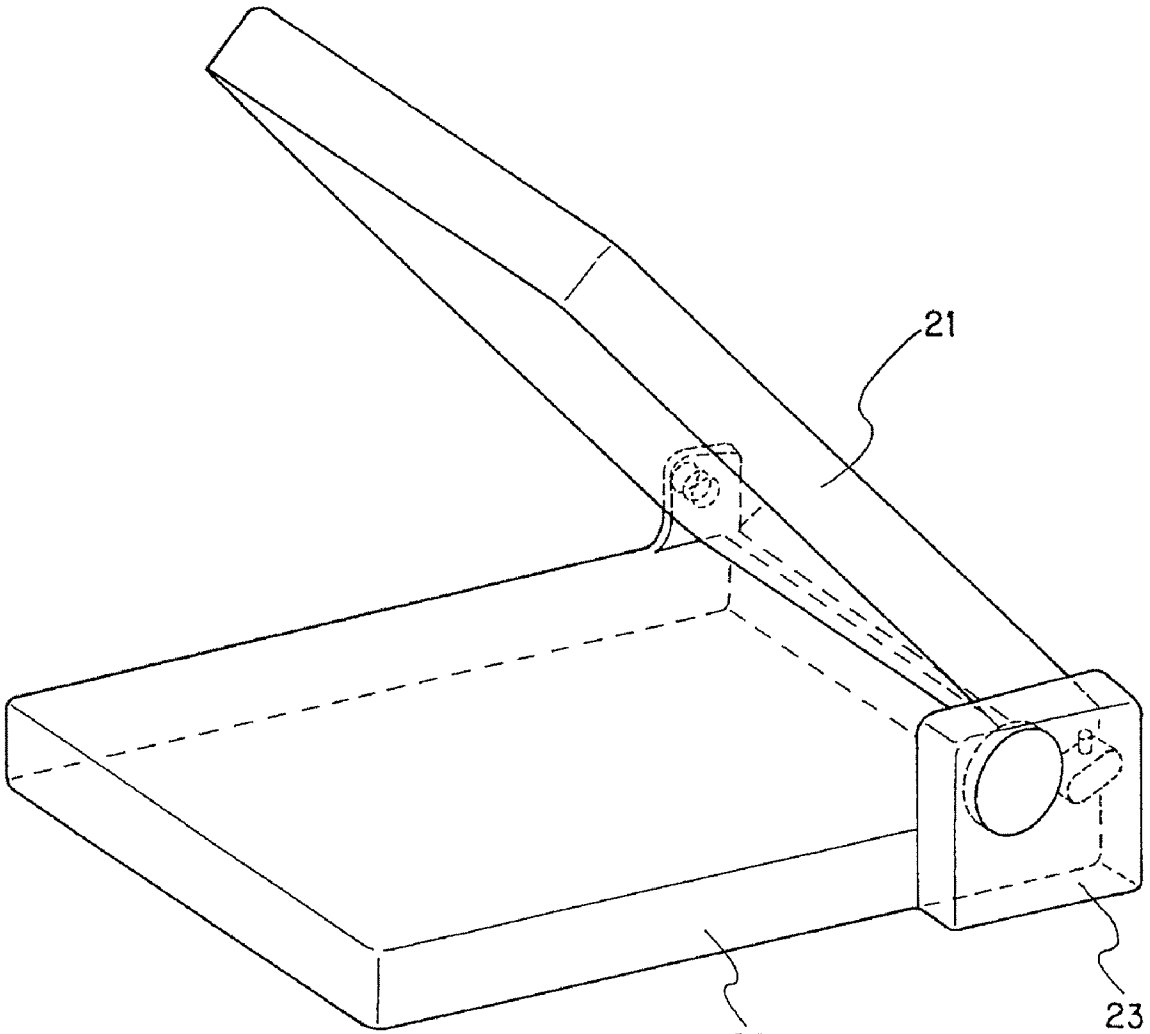
FIG. 3 is a perspective view for explaining an opening position of an upper cover of the relay conveying unit according to the first embodiment of the present invention.

Next, the relay conveying unit 2 as a relay conveying means will be described. FIGS. 2, 3 show the relay conveying unit 2 of the first embodiment.

As shown in FIGS. 2, 3, the relay conveying unit 2 is so constructed that an upper cover 21 as an opening/closing member can be opened and closed up and downwardly with respect to a lower cover 22 for the jam treatment and consequently, a conveying path can be exposed.

A one-way type damper mechanism 23 is provided at a hinge portion of the upper cover 21 of the relay conveying unit 2. Further, the relay conveying unit 2 is provided with the lower cover 22 which makes a pair with the upper cover 21. The upper cover 21 and the lower cover 22 are connected through the damper mechanism 23. The damper mechanism is so constructed that a force of the damper of the damper mechanism 23 is applied in the direction of closing the upper cover 21. Because the force of the damper of the damper mechanism 23 is applied, the upper cover 21 can be blocked from being closed suddenly thereby preventing something from being sandwiched by the upper cover 21 and the lower cover 22.

The opening/closing mechanism is constituted of the upper cover 21, the lower cover 22 as a main body of the opening/closing mechanism and the damper mechanism 23.

Figure 4:
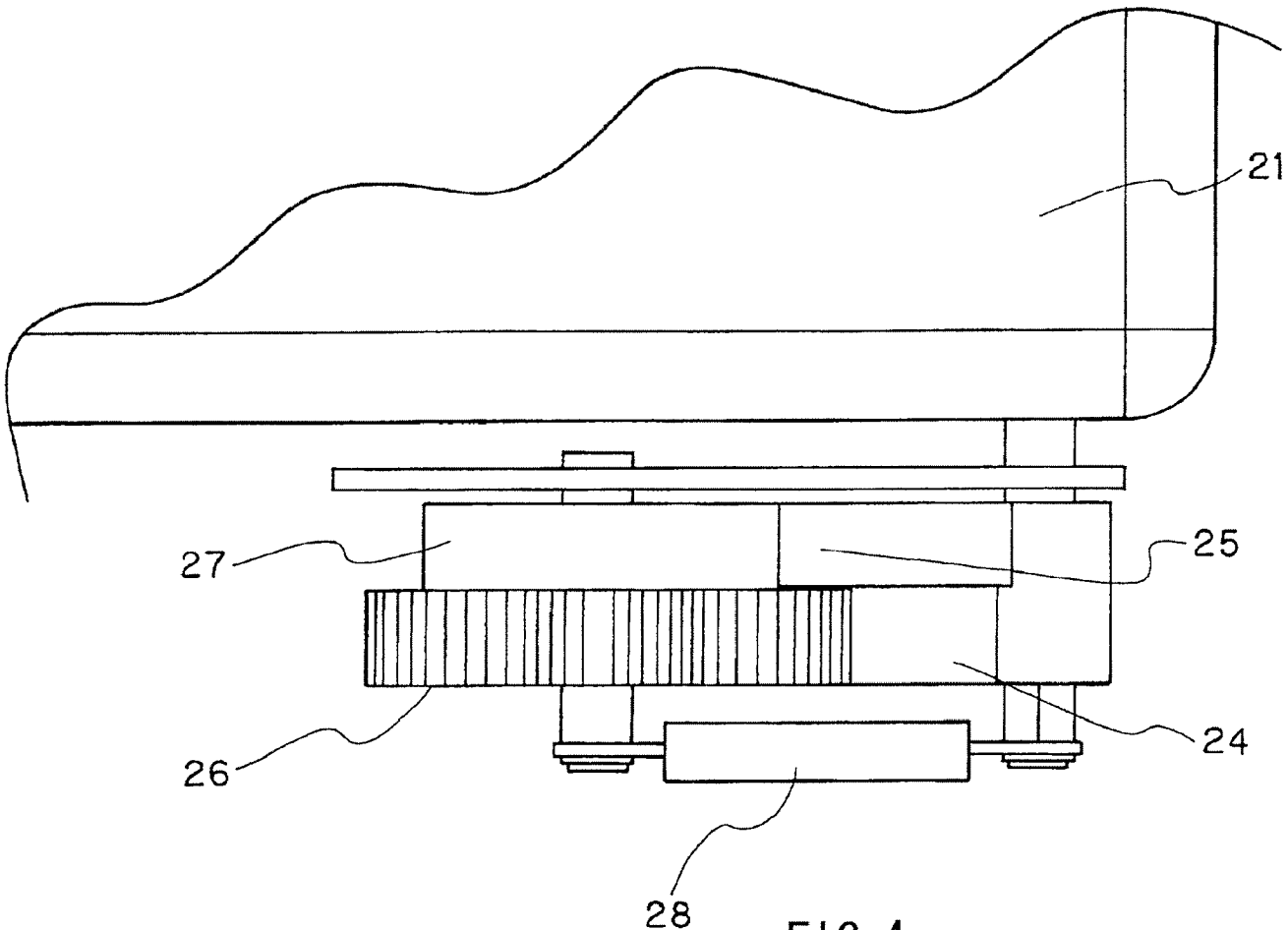
FIG. 4 is a top view showing a damper mechanism of the relay conveying unit according to the first embodiment of the present invention.
Figure 5:
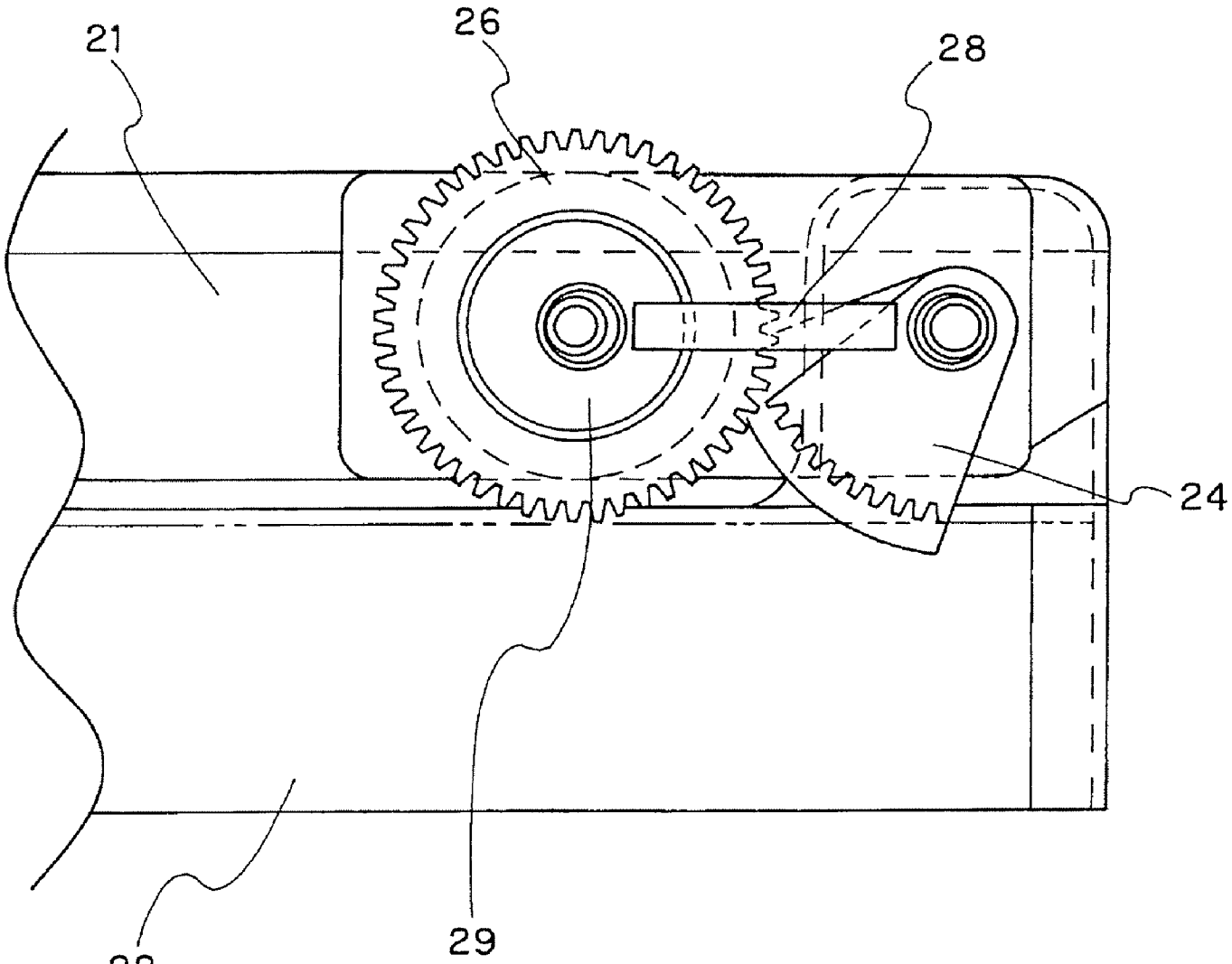
FIG. 5 is a front view showing the damper mechanism of the relay conveying unit according to the first embodiment of the present invention.

FIGS. 4, 5 show the damper mechanism 23 of the relay conveying unit 2 of the first embodiment. As shown in FIGS. 4, 5, the damper mechanism 23 comprises a fractional gear 24 as a gear whose some part of teeth is missing connected to the upper cover 21 of the relay conveying unit 2 and a damper gear 26 on which a reaction force of the damper is applied. Here, the damper gear 26 is a gear having 50 teeth. The fractional gear 24 has 10 teeth which engage the teeth of the damper gear 26. No tooth is provided at a portion other than the 10 teeth on the outer circumference of the fractional gear 24. The fractional gear 24 and damper gear 26 are made of resin. The fractional gear 24 and damper gear 26 are formed of for example, polyacetal (POM).

The fractional gear 24 has a cam 25 integrated therewith on an identical axis. The damper gear 26 is supported rotatably by the lower cover 22. The damper gear 26 has a flange 27 integrated with the gear on an identical axis. The fractional gear 24 and damper gear 26 are urged by a spring 28 in the direction that they approach each other. The factional gear 24 and damper gear 26 are constructed to be capable of departing from each other by the cam 25.

FIG. 5 shows the damper mechanism 23 when the upper cover 21 of the relay conveying unit 2 is closed. As shown in FIG. 5, the fractional gear 24 is out of engagement with the damper gear 26 when the upper cover 21 is closed. That is, when the upper cover 21 is closed, the damper gear 26 opposes a portion having no teeth of the fractional gear 24.

Figure 6:
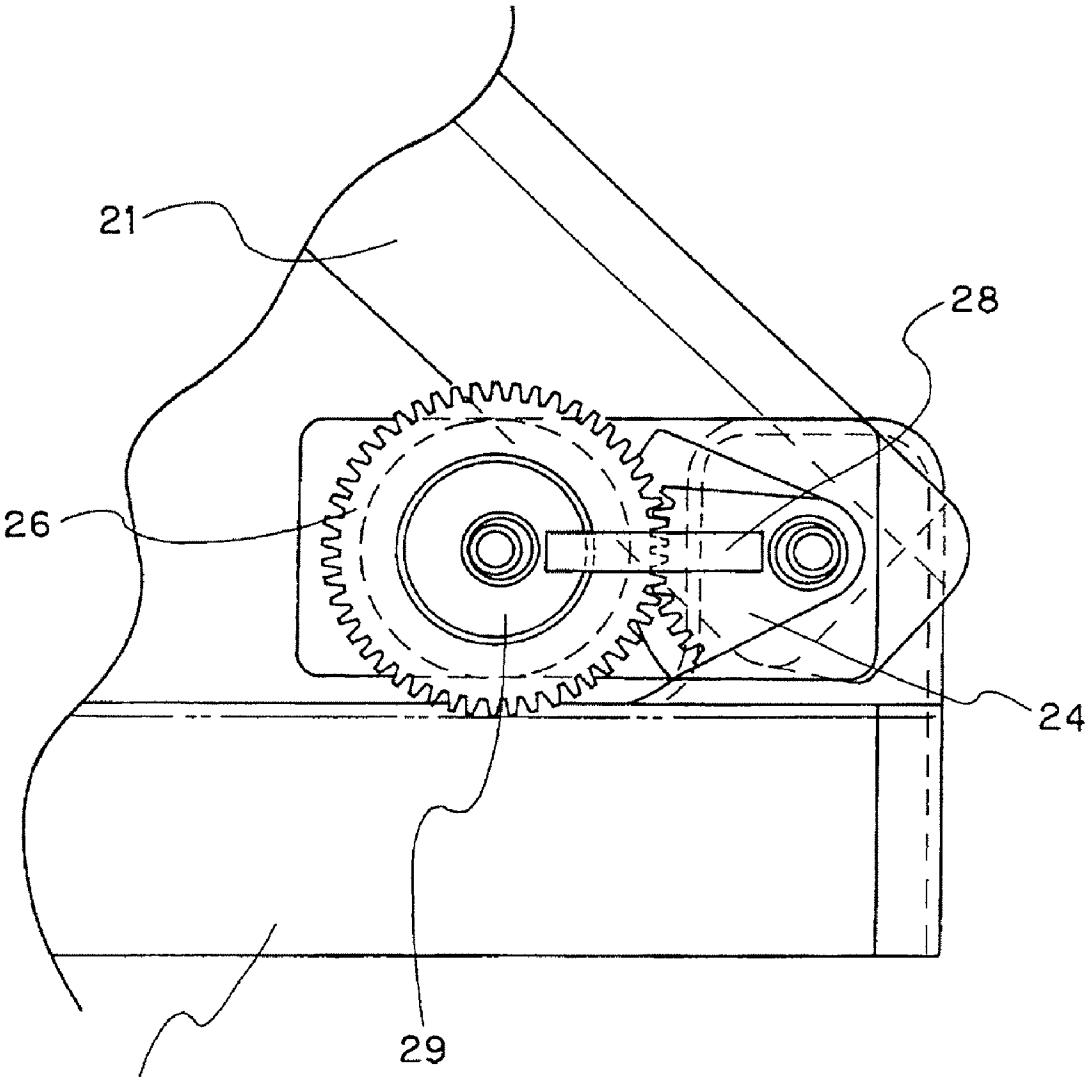
FIG. 6 is a front view showing a damper mechanism when the upper cover of the relay conveying unit according to the first embodiment of the present invention is opened.

As shown in FIG. 6, the tooth portion of the fractional gear 24 is formed so that the fractional gear 24 engages the damper gear 26 when the upper cover 21 is opened. That is, when the upper cover 21 is opened, the tooth portion of the fractional gear 24 engages the damper gear 26. In the meantime, the one-way damper 29 is connected on the shaft of the damper gear 26 so that the force of the damper is applied only in a direction in which the upper cover 21 of the relay conveying unit 2 is closed. Further, the fractional gear 24 is connected to the upper cover 21 of the relay conveying unit 2 and rotated with opening/closing activity of the upper cover 21.

Figure 7B:
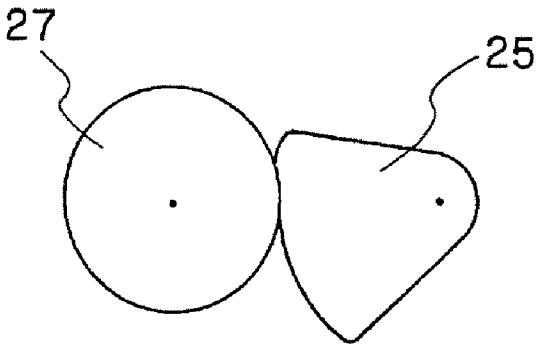
FIG. 7B is a front view showing a cam mechanism before the damper gear is released.
Figure 7A:
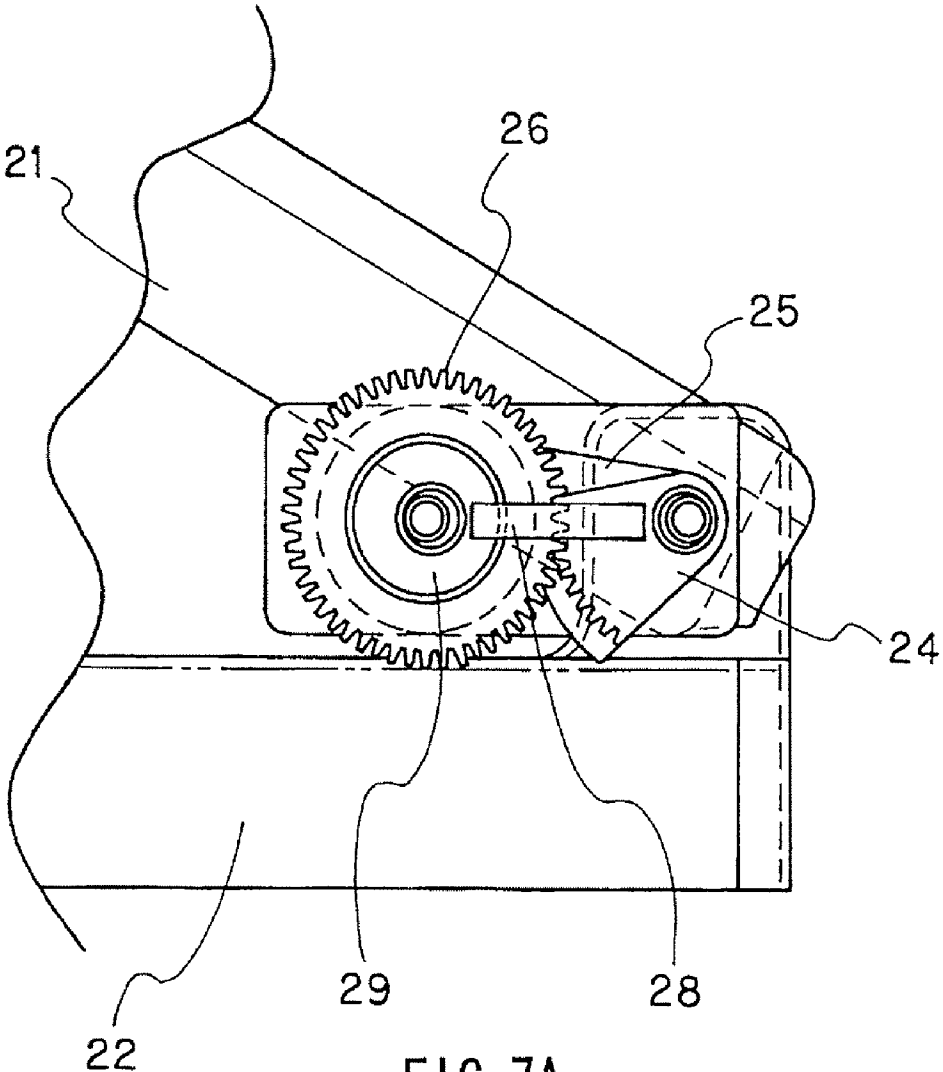
FIG. 7A is a front view showing a condition of the damper gear and fractional gear before the damper gear is released.

FIG. 7 shows the damper mechanism 23 in a condition before the damper gear 26 of the relay conveying unit 2 departs from the fractional gear 24. FIG. 7A shows an engagement condition between the damper gear 26 and the fractional gear 24. FIG. 7B shows a cam mechanism constituted of a flange 27 provided on the damper gear 26 and a cam 25 provided on the fractional gear 24. As shown in FIG. 7, at a point in which engagement between the fractional gear 24 and the damper gear 26 decreases, that is, at a point in which two engaging teeth remain according to this embodiment, the cam 25 integrated with the fractional gear 24 begins to make contact with the flange 27 of the damper gear 26.

Figure 8B:
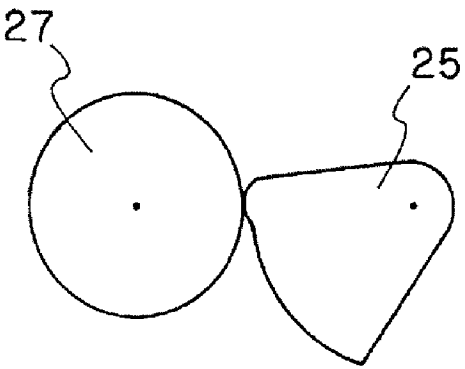
FIG. 8B is a front view showing a cam mechanism when the damper gear is released.
Figure 8A:
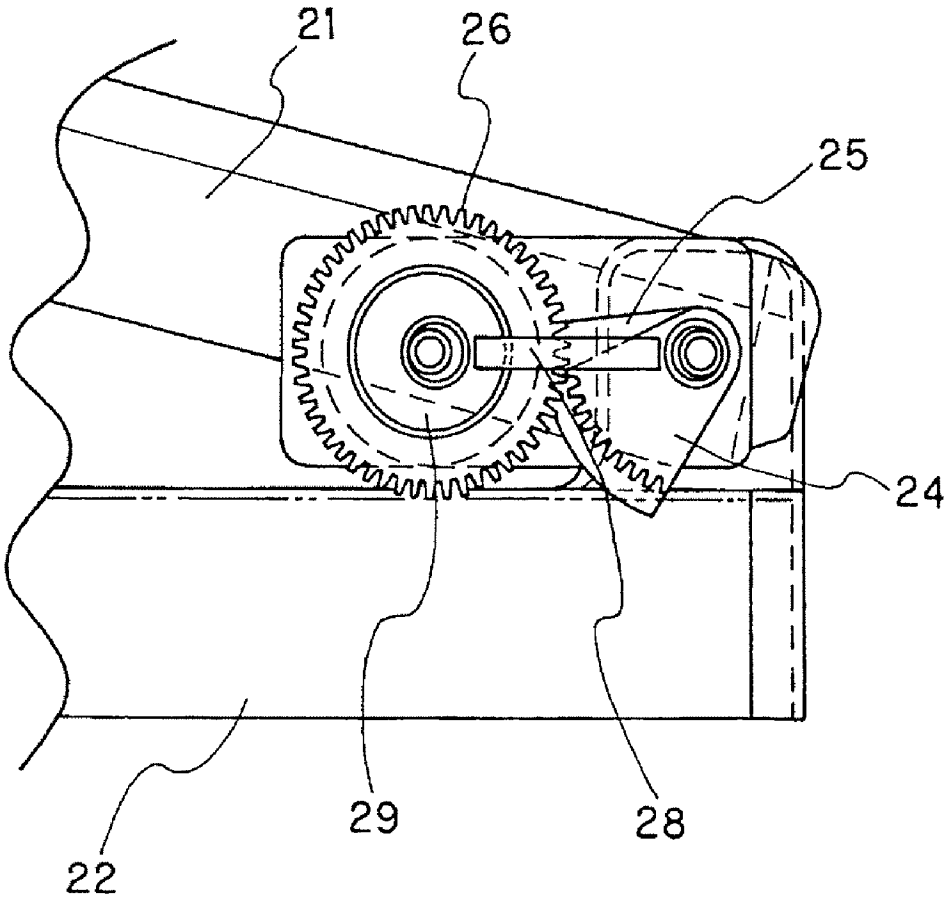
FIG. 8A is a front view showing a condition of the damper gear and fractional gear when the damper gear is released.

If the upper cover 21 is rotated in its closing direction, the fractional gear 24 continues to rotate so that the condition shown in FIG. 8 is present. FIG. 8 shows the damper mechanism 23 in a condition in which the damper gear 26 and the fractional gear 24 depart from each other. FIG. 8A shows an engagement condition of the damper gear 26 and the fractional gear 24. FIG. 8B shows a cam mechanism constituted of the flange 27 provided on the damper gear 26 and the cam 25 provided on the fractional gear 24.

When the upper cover 21 is rotated in the closing direction from the condition of FIG. 7, the fractional gear 24 continues to rotate as it is so that the axes of the fractional gear 24 and the damper gear 26 depart from each other by the activity of the cam 25 so as to produce a condition shown in FIG. 8. Thus, a force which should be applied to the tooth face when the upper cover 21 is rotated in the closing direction is received by the cam 25 and the flange 27.

That is, when the upper cover 21 is rotated in the closing direction, the damper gear 26 is moved from an opening/closing angle in which the damper gear 26 opposes the tooth portion of the fractional gear 24 to an opening/closing angle in which the damper gear 26 opposes the portion having no tooth of the fractional gear 24. At this time, the cam 25 and the flange 27 act to bring the axes of the fractional gear 24 and the damper gear 26 away from each other so that the engagement between the damper gear 26 and the fractional gear 24 is released. Consequently, a force applied to the tooth face is relaxed. Thus, a sound generated when the tooth of the fractional gear 24 and the tooth of the damper gear 26 leave each other is relaxed.

In the meantime, in the first embodiment, the backlash between the damper gear 26 and the fractional gear 24 is set to 0.1 mm and the quantity of departure is set to 1 mm.

As described above, according to the first embodiment, the cam 25 is provided coaxially with the fractional gear 24 which interlocks with the upper cover 21 as the opening/closing member. Then, the flange 27 as a cam contact portion which receives the cam 25 is provided on the damper gear 26 which produces a force, a damper force, resisting to the motion of the upper cover 21 when the upper cover 21 is rotated in the closing direction. Consequently, without use of a large fractional gear, tooth skip sound which occurs when the reaction force of the damper is applied can be relaxed largely when the upper cover of the relay conveying unit is closed.

In the meantime, this embodiment presents an example in which a problem about sound generated when the tooth of the gear is disengaged by a damping force of the damper 29 because the damper 29 is connected to the shaft of the damper gear 26 is conceivable. However, even an example in which no damper is incorporated in a gear which engages the fractional gear can relax generation of the sound by keeping the axes of the two gears away from each other by means of the cam mechanism as already explained.

Second Embodiment

Figure 9:
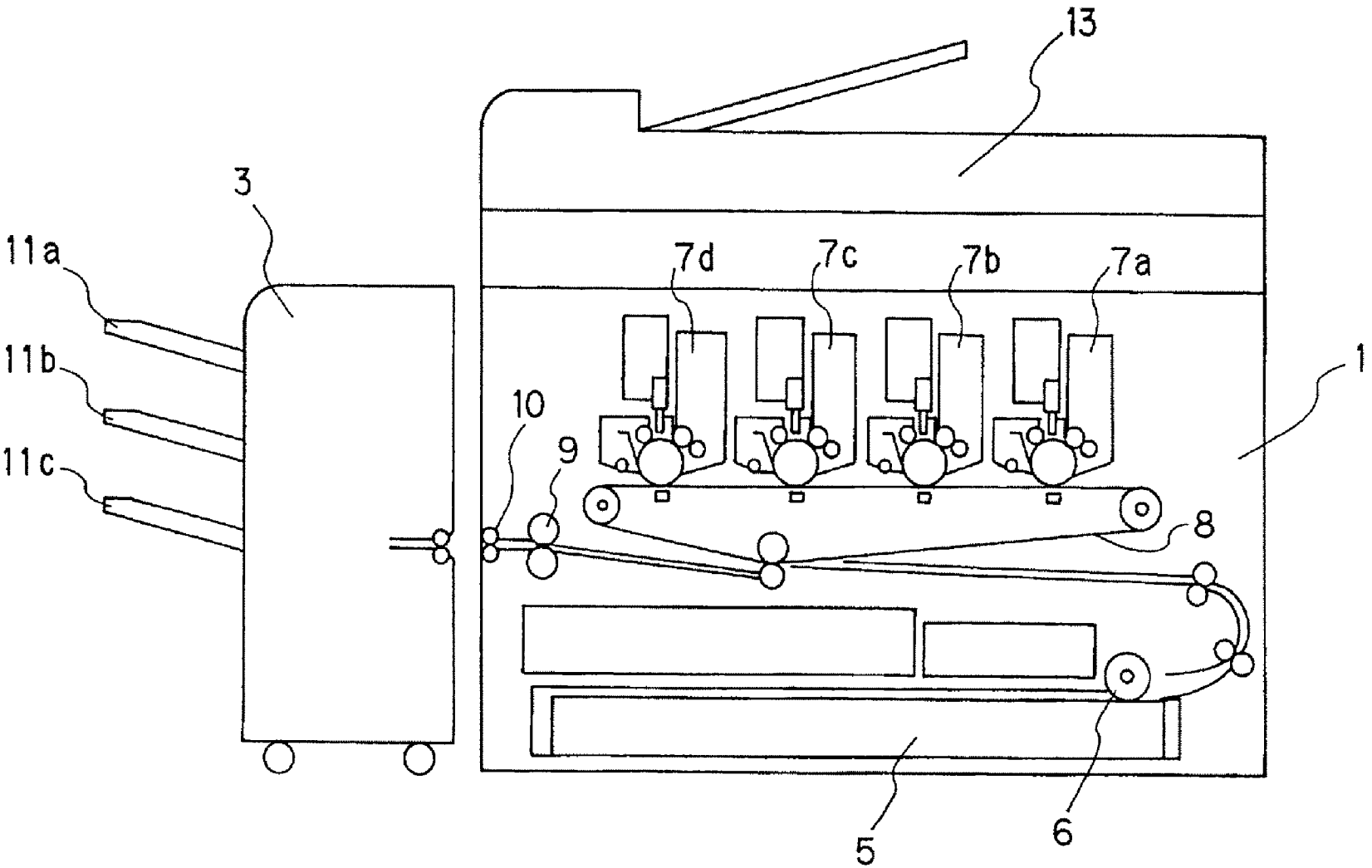
FIG. 9 is a sectional view showing the structure of major components of the color image forming apparatus according to a second embodiment of the invention.

Next the image forming apparatus of the second embodiment of the present invention will be described. In the second embodiment, description of the same structure as the first embodiment is omitted. FIG. 9 shows the structure of major portions of the color image forming apparatus of the second embodiment.

As shown in FIG. 9, the color image forming apparatus of the second embodiment comprises the image forming apparatus main body 1, an image reading unit 13 and the sheet post-processing unit 3.

The image reading unit 13 is provided on the top of the image forming apparatus main body 1. A sheet feeding means 6 is provided on the bottom of the image forming apparatus main body 1. The transfer unit 8, the fixing unit 9 and the normal sheet discharge portion 10 are provided above this sheet feeding means 6.

The image forming portion 7 is an image forming means for forming an image on a sheet. The transfer unit 8 is a unit for transferring an image formed by the image forming portion 7 to the sheet. The fixing unit 9 is a unit for fixing the toner image transferred to the sheet onto the sheet. The normal sheet discharge portion 10 is a unit for discharging the sheet on which the toner image is fixed out of the apparatus main body 1.

Figure 10:
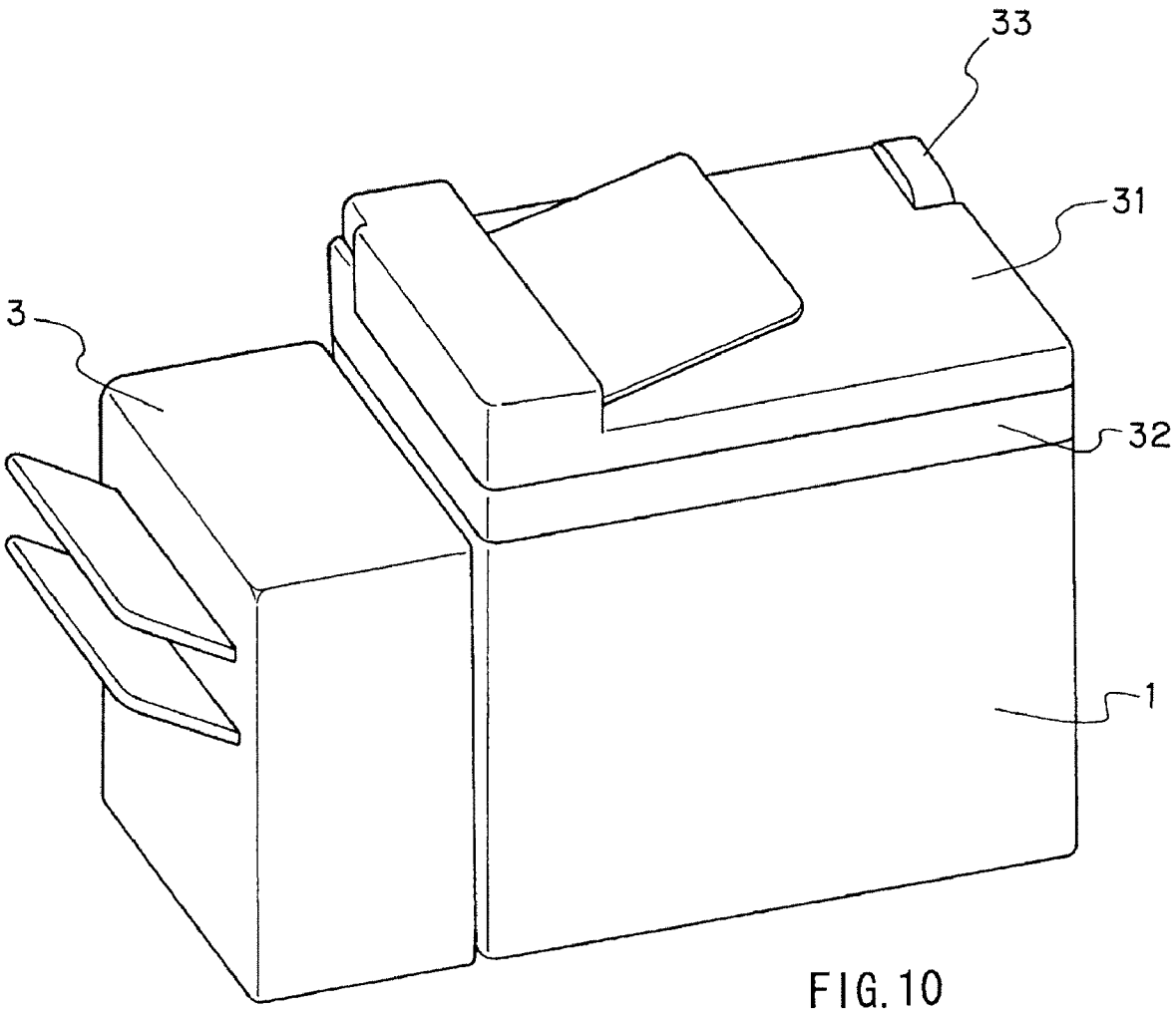
FIG. 10 is a perspective view of the color image forming apparatus according to the second embodiment of the invention.
Figure 11:
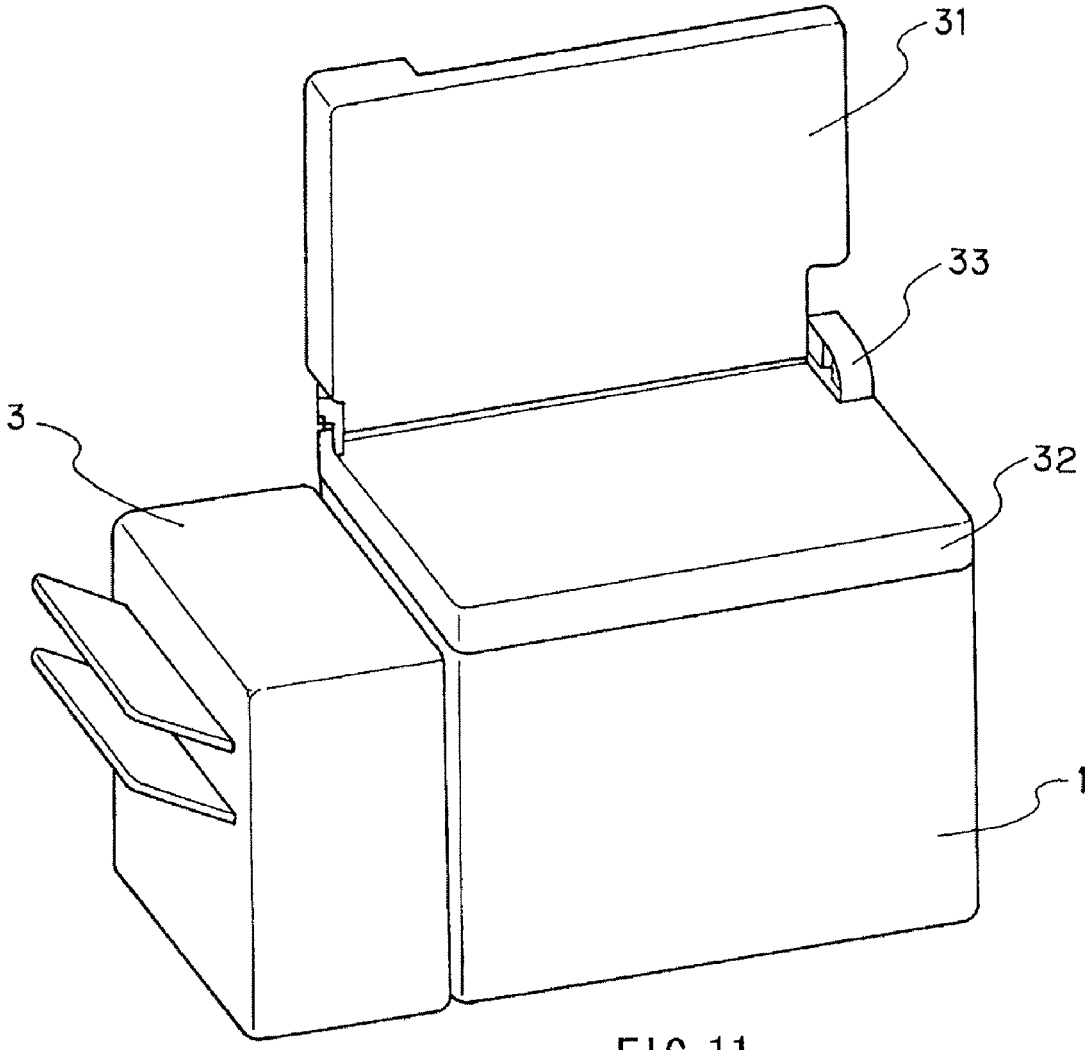
FIG. 11 is a perspective view showing a condition in which a document cover of the color image forming apparatus according to the second embodiment of the invention is opened.

FIG. 10 shows a color image forming apparatus of the second embodiment and FIG. 11 shows a condition in which the document cover is opened.

As shown in FIG. 10, a document base 32 and a document cover 31 for covering this document base 32 are provided on the top of the image forming apparatus main body 1.

As shown in FIG. 11, the document cover 31 is provided rotatably with respect to a hinge on the deep side of the document base 32. A damper unit 33 identical to the first embodiment is provided on the right deep side of the document base 32. When the document cover 31 is rotated, the fractional gear 24 interlocking with the cam within the damper unit 33 is rotated. The document base 32 is equipped with the damper gear 26 (not shown in FIG. 11) which has a flange so that it engages the fractional gear 24 like the first embodiment.

The second embodiment can provide the same effect as the first embodiment.

The embodiments of the present invention have been described specifically above. The present invention is not restricted to the above-described embodiments but may be modified in various ways based on the technical philosophy of the present invention. For example, numeric values mentioned in the above embodiments are just an example and a different value may be used depending on a necessity.

This application claims priority from Japanese Patent Application No. 2006-71147 filed Mar. 15, 2006, which hereby incorporated by reference herein.

What is claimed is:

1. An opening/closing mechanism comprising;

an opening/closing member capable of opening and closing with respect to a main body;

a first gear having a tooth portion and a portion with no teeth, the first gear rotating with opening and closing of the opening/closing member;

a second gear engaging the first gear, provided rotatably on the main body; and a cam mechanism including a cam rotatable with the first gear and a cam contact portion making contact with the cam, wherein when the opening/closing member is opened, the second gear engages the tooth portion of the first gear and when the opening/closing member is closed, the second gear opposes the portion with no teeth of the first gear, and when the opening/closing member is rotated to be closed so that it is moved from an opening/closing angle in which the second gear opposes the tooth portion of the first gear to an opening/closing angle in which the second gear opposes the portion with no teeth of the first gear, the cam mechanism acts to bring the axes of the first gear and the second gear away from each other.

2. The opening/closing mechanism according to claim 1 wherein the second gear is a gear for providing with a resistance force when the opening/closing member is rotated in a closing direction.

3. The opening/closing mechanism according to claim 1 wherein the cam is constituted integrally with the first gear.

4. The opening/closing mechanism according to claim 1 wherein the cam contact portion is constituted integrally with the second gear.

5. The opening/closing mechanism according to claim 1 wherein the first gear and the second gear are made of resin.

6. The opening/closing mechanism according to claim 1 wherein at the opening/closing angle in which the first gear and the second gear engages through at least one tooth of each, the cam mechanism acts to bring the axes of the first gear and the second gear away from each other.

7. An image forming apparatus comprising:

an image forming portion for forming an image on a sheet and the opening/closing mechanism described in claim 1.

8. An opening/closing mechanism comprising:

an opening/closing member capable of opening and closing with respect to a main body;

a first gear rotating with opening and closing of the opening/closing member;

a second gear engaging the first gear; and a cam mechanism which acts to bring the axes of the first gear and the second gear away from each other when the opening/closing member is closed.

9. A gear mechanism comprising:

a first gear;

a second gear which engages the first gear; and a cam mechanism including a cam portion provided on one of the first gear and the second gear and a cam contact portion which is provided on the other gear of the first gear and the second gear and makes contact with the cam portion, the cam mechanism acting to release the engaging of the first gear and the second gear by bring the axes of the first gear and the second gear away from each other.

10. A gear mechanism to claim 9 wherein the first gear has a tooth portion and a portion with no teeth, and when the second gear moves from a position in which the second gear engages the tooth portion of the first gear to a position in which the second gear opposes a portion with no teeth of the first gear, the cam mechanism acts to bring the axes of the first gear and the second gear away from each other.

* * * * *